US005098255A

United States Patent [19]

Weber

[11] Patent Number: 5,098,255

[45] Date of Patent: Mar. 24, 1992

[54] VARIABLE GEOMETRY PITOT PUMP

[75] Inventor: Kent Weber, Rockford, Ill.

[73] Assignee: Sundstrand Corporation, Rockford, Ill.

[21] Appl. No.: 644,913

[22] Filed: Jan. 23, 1991

[51] Int. Cl.[5] ..... F04D 11/00; F04D 27/00; F04D 29/00

[52] U.S. Cl. ..... 415/88; 415/89

[58] Field of Search ..... 415/88, 89

[56] References Cited

U.S. PATENT DOCUMENTS

| | | | |
|---|---|---|---|
| 1,722,289 | 9/1928 | Gurley | 415/89 |
| 2,124,914 | 7/1934 | Fottinger . | |
| 3,093,080 | 6/1963 | Tarifa et al. | 415/88 |
| 3,994,618 | 11/1976 | Erickson | 415/89 |
| 4,267,964 | 5/1981 | Williams | 415/89 |
| 4,549,861 | 10/1985 | Blain | 418/55 |

FOREIGN PATENT DOCUMENTS

| | | |
|---|---|---|
| 924143 | 7/1947 | France . |
| 409130 | 2/1945 | Italy . |

*Primary Examiner*—Edward K. Look
*Assistant Examiner*—Michael S. Lee
*Attorney, Agent, or Firm*—Marshall, O'Toole, Gerstein, Murray & Bicknell

[57] ABSTRACT

Prior centrifugal pitot pumps have suffered from reduced efficiency and inability to control flow parameters during operation. In order to overcome these problems, a pitot pump for pressurizing a fluid includes a rotatable housing having a housing inlet through which fluid may be passed wherein a rotating flow of fluid is induced in a volume of space within the housing, a probe disposed in the housing and having a movable probe inlet disposed in the volume of space and a probe outlet at which outlet fluid flow is established and means for moving the probe inlet within the range of positions within the rotating flow of fluid whereby a parameter of the outlet fluid flow can be controlled. The pitot pump has improved controllability and efficiency.

18 Claims, 2 Drawing Sheets

VARIABLE GEOMETRY PITOT PUMP

TECHNICAL FIELD

The present invention relates generally to pumps of the centrifugal type, and more particularly to a pitot pump.

BACKGROUND ART

Pitot pumps are often used when fluids at high pressures and low flow rates are to be delivered to a utilization device. Pitot pumps are more efficient than other types of centrifugal pumps due to lower drag losses encountered during operation. Conventional pitot pumps utilize a fixed probe having an inlet comprising a hole disposed in a tip of the probe and an outlet wherein the cross-sectional area of the probe flow path increases from the inlet to the outlet The probe tip is disposed in a body of rotating fluid within a rotating housing such that the hole faces the flow of rotating fluid. The fluid is diffused after entering the probe to convert dynamic pressure into static pressure.

The outlet pressure or flow of a pitot pump can be controlled in one or a combination of two ways. Firstly, the speed of the prime mover that drives the pump can be controlled so that the velocity of the rotating body of fluid is in turn controlled. Since outlet pressure is related to the square of the velocity of the rotating body, it follows that outlet pressure can be controlled in this fashion. However, this technique can only be used where the speed of the prime mover can be adjusted to provide the desired pump output conditions. In applications such as in aircraft where a jet engine drives the pitot pump that in turn pumps fuel to a combustor of the jet engine, the speed of the jet engine varies in response to engine power requirements which do not match pump output requirements, and hence this flow control method is not available under most circumstances.

An alternative to the foregoing technique utilizes a throttling device or other flow control device that modulates the flow of pressurized fluid from the pump. However, such flow control devices are inefficient and convert energy into heat that in turn undesirably raises the temperature of the fluid.

Italian Patent 409,130 discloses a device having a movable pitot probe. No apparatus or device is shown for controlling the probe movement, however.

French Patent 924,143 discloses a device having a plurality of probes each of which appears to be movable. However, as with the Italian Patent noted above, no apparatus or device is shown for controlling the movement of the probes.

Erickson, U.S. Pat. No. 3,994,618 discloses a multiple outlet pitot pump that produces different output flows and/or pressures. A plurality of pitot tubes are disposed in the path of a rotating body of fluid. The pitot tubes are disposed at differing distances from the axis of rotation of the body of fluid. The tubes deliver fluid to discharge ducts at different flow rates.

Fottinger, U.S. Pat. No. 2,124,941 discloses a movable pick-up tube with a hydrodynamic shoe that keeps the pick-up tube submerged under a liquid-air interface in a partially filled scoop pump. However, the movement of the pick-up tube is not controlled to vary pressure or flow output.

Gurley, U.S. Pat. No. 1,722,289 discloses a two chamber pitot pump having a pitot probe in each chamber. The pitot probes, however, are not movable.

Blain, U.S. Pat. No. 4,549,861, assigned to the assignee of instant application, discloses a positive displacement machine having a pitot pickup tube which is movable for ease of assembly. In operation, the pitot tube remains stationary.

SUMMARY OF THE INVENTION

In accordance with the present invention, a pitot pump includes means for controlling a parameter of output flow of the pump in a simple and effective manner.

More particularly, in accordance with a first aspect of the present invention, a pitot pump for pressurizing a fluid includes a rotatable housing having a housing inlet through which fluid may be passed and means for inducing a rotating flow of fluid in a volume of space within the housing. A probe is disposed within the housing and includes a movable probe inlet disposed in the volume of space and a probe outlet at which an outlet fluid flow is established. Means are provided for moving the probe inlet within a range of positions within the rotating flow of fluid whereby a parameter of the outlet fluid flow can be controlled.

Preferably, the rotating flow of fluid is induced in a circular direction about a flow axis of rotation and the probe is rotatable about a probe axis of rotation displaced from the flow axis. In accordance with a highly preferred form the invention, the probe includes a first portion transverse to the flow axis that carries the probe inlet and a second portion that carries the probe outlet. The moving means preferably comprises a vane disposed on the probe which is responsive to a pressure differential.

Also according to this aspect of the present invention, the outlet fluid flow is developed at an outlet pressure and the vane receives the outlet pressure on a first side thereof and a second pressure on a second side thereof opposite the first side. In a first embodiment of this aspect of the invention, the second pressure is exerted by a spring. In an alternative embodiment, the vane receives the inlet pressure of the pump and pressure exerted by a spring on the second side thereof.

In a still further embodiment, the vane receives the inlet pressure on a first side thereof and a second pressure on a second side thereof opposite the first side. In accordance with this embodiment, the second pressure is developed by a servovalve responsive to outlet pressure. Further, the servovalve includes an input that receives a flow of fluid at the outlet pressure and an output at which the second pressure is developed wherein the servovalve is controlled by an electric signal developed by a control circuit. The control circuit is preferably responsive to a feedback signal representing outlet fluid flow rate whereby such flow rate is maintained at substantially a constant value. Alternatively, the control circuit may be responsive to a feedback signal representing outlet pressure whereby such pressure is maintained at substantially a constant value.

In accordance with yet another aspect of the present invention, a pitot pump for pressurizing a fluid delivered to the pump includes a rotatable housing having a housing inlet through which fluid is passed and means for inducing a rotating flow of fluid about a flow axis in a volume of space within the housing. A probe is disposed in the housing and includes a first portion substantially perpendicular to the flow axis and carrying a flow inlet in an end thereof movable within the volume of space and a second portion coupled to the first portion and carrying a probe outlet at which an outlet fluid flow at an outlet pressure is established. A vane is coupled to the second portion of the probe and is responsive to the outlet pressure for controlling the position of the probe to thereby control a parameter of the outlet fluid flow In accordance with one embodiment of this aspect of the present invention, the vane is further responsive to a pressure exerted by a spring. In an alternative embodiment, the vane is further responsive to the pump inlet pressure and a pressure exerted by a spring.

In yet another embodiment, a servovalve is provided having an inlet that receives the output pressure and an outlet in fluid communication with the vane wherein the servovalve is responsive to a control circuit. The control circuit may be responsive to a feedback signal representing outlet fluid flow rate wherein such flow rate is maintained at substantially a constant value. Alternatively, the control circuit may be responsive to a feedback signal representing outlet pressure whereby such pressure is maintained at substantially a constant value.

The pitot pump of the present invention allows output flow or pressure to be accurately controlled in applications where prime mover speed cannot be controlled and without the use of inefficient throttling devices or other flow control devices. Efficiency is thereby improved and heating of fluid is kept to a minimum.

DESCRIPTION OF THE PREFERRED EMBODIMENTS

Figure 1:
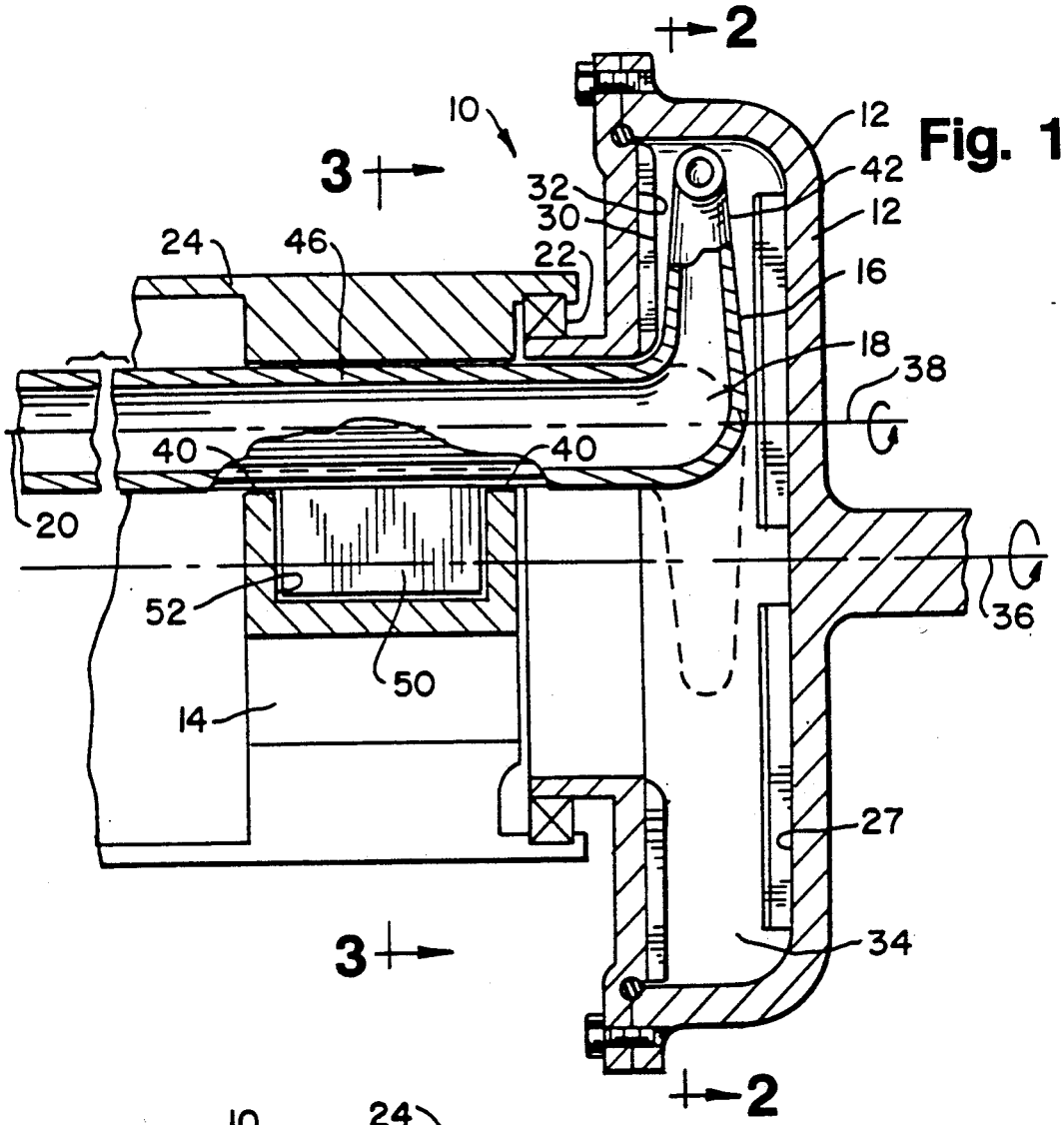
FIG. 1 comprises a sectional view of a pitot pump according to a first embodiment of the present invention.

Referring to FIG. 1, a pitot pump 10 according to the present invention includes a rotating housing 12, a fluid inlet supply port 14 and a probe 16 having an internal flow passage 18 leading to a pump outlet 20. Fluid leakage from the rotating housing 12 is prevented by a face seal 22.

Figure 2:
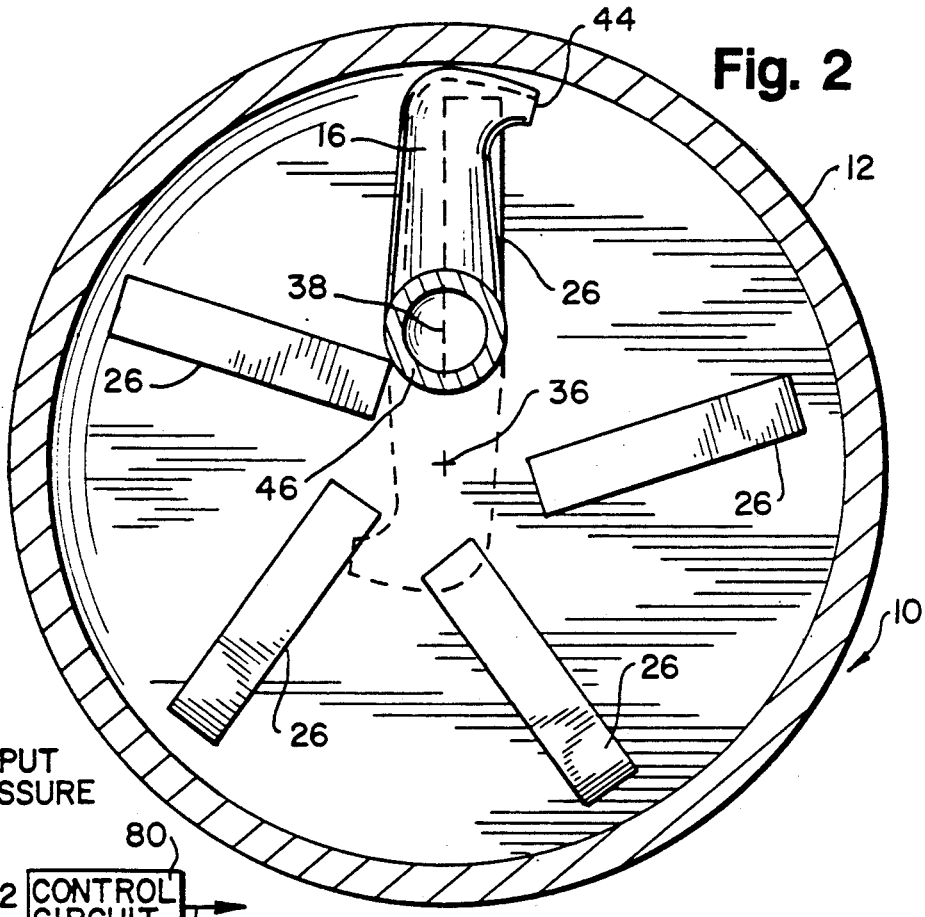
FIG. 2 is a sectional view taken along the lines 2—2 of FIG. 1.

Referring also to FIG. 2, the rotating housing 12 includes a plurality of impeller vanes 26 disposed on a face 27. Corresponding impeller vanes 30 (FIG. 1) are disposed on an opposite face 32 of the rotating housing 12. As the rotating housing 12 is rotated by a prime mover (not shown), fluid entering via the inlet supply port 14 is directed against the impeller vanes 26 and 30. These vanes cause fluid to flow in a circular path in a volume of space 34 within the rotating housing 12 about a flow axis of rotation 36.

If desired, the vanes 26, 30 may be replaced by a series of bores or holes in the walls of the housing 12. As before, fluid entering the housing 12. As before, fluid entering the housing 12 is caused to flow in a circular path in the volume of space 34 by the bores or holes.

The pitot probe 16 is rotatable about a probe axis 38 which is displaced from the flow axis 36. The probe 16 is disposed against bearing surfaces 40 within the fixed pump housing 24. The probe 16 includes a first portion 42 that carries an inlet 44 shown in FIG. 2. The first portion 42 is transverse to the flow axis 36 and the inlet 44 is oriented in a direction opposite to the direction of flow of the fluid. The probe 16 further includes a second portion 46 that is substantially parallel to the flow axis 36 and carries the outlet 20.

Depending from the second portion 46 is a vane 50 which is in turn disposed within a recess 52 within the fixed housing 24. Generally, the vane 50 is responsive to a pressure differential to adjust the probe rotational position whereby the probe inlet 44 is positioned at a particular radial distance within the circular fluid flow.

Figure 3:
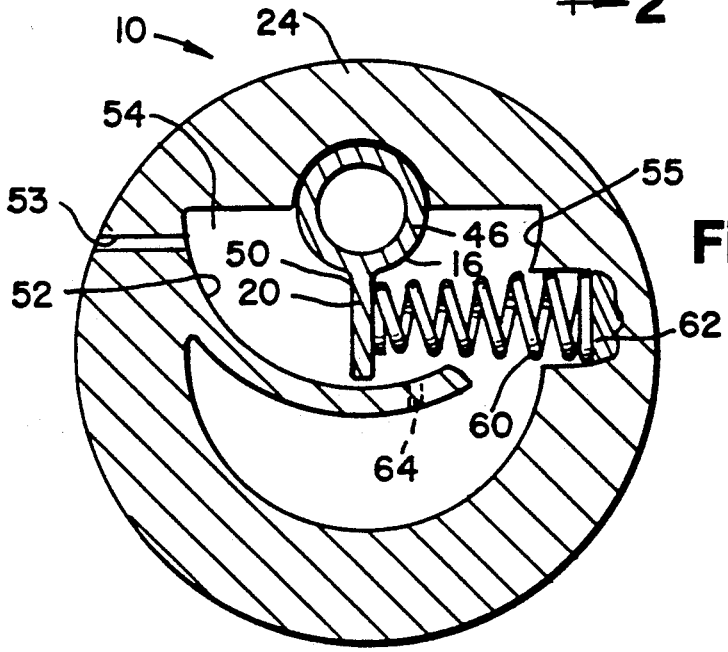
FIG. 3 comprises a sectional view taken generally along the lines 3—3 of FIG. 1.

With specific reference to FIG. 3, according to a first embodiment, fluid flow at a pressure equal to the outlet pressure at the outlet 20 is provided through an orifice 53 to a first portion 54 of the recess 52 on a first side of the vane 50. A spring 60 exerts a second pressure on a second side of the vane 50 opposite the first side and is mounted between the vane 50 and a wall 62 of the fixed housing 24. In operation, the pressure exerted by the spring 60 is balanced during steady state operation by the outlet pressure of the fluid exerted on the first side of the vane 50 such that a parameter of the outlet flow from the probe 16 is controlled. Preferably, the output pressure is controlled at a substantially constant value as determined by the spring rate of the spring 60. Alternatively, output flow can be maintained at a substantially constant value, if desired.

According to an alternative embodiment, a small fluid flow orifice 64 (shown in dotted lines in FIG. 3) is provided between the inlet supply port 14 and a second portion 55 of the recess 54. In this case, the inlet pressure and the pressure of the spring 60 act on the second side of the vane 50 whereas the output pressure acts on the first side of the vane 50 so that constant outlet pressure is obtained. The magnitude of the outlet pressure is controlled by the spring rate of the spring 60, and the sizes of the orifices 53, 64 interconnecting the inlet supply port 14 to the recess portion 55 and the outlet 20 to the recess portion 54.

Figure 4:
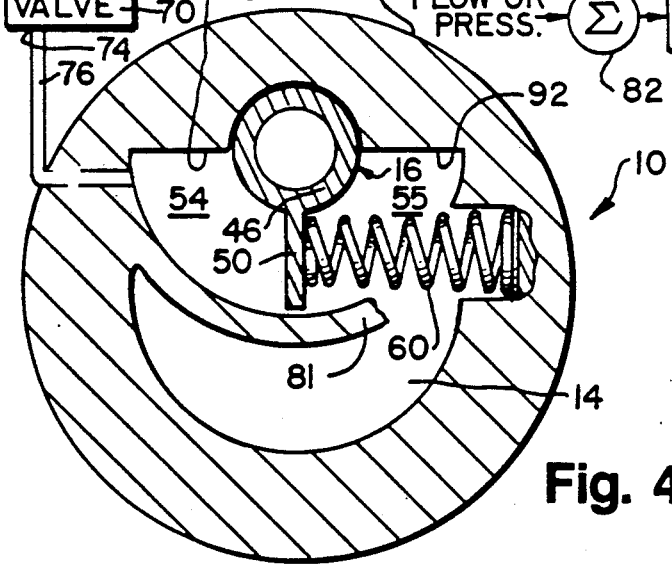
FIG. 4 comprises a view similar to FIG. 3 illustrating an alternative embodiment of the present invention.

FIG. 4 illustrates another embodiment of the present invention wherein a servovalve 70 includes an inlet 72 that receives the pump output pressure and an outlet 74 interconnected with the recess portion 54 by a conduit 76. In this embodiment, pressure within the recess portion 54 is controlled by the servovalve 70 in response to a control signal developed by a control circuit 80. The control circuit 80 is in turn responsive to a reference signal REF that represents the desired outlet pressure or flow of the pump 10. The recess portion 55 contains the bias spring 60 and is in fluid communication with the inlet supply port 1 via an orifice 81. Similar to the previous embodiment, the vane 50 is driven to a position which in turn maintains the output pressure or flow at a controlled value. Unlike the previous embodiment, however, outlet pressure and flow can be varied in a closed loop fashion by modifying the reference signal REF.

Figure 5:
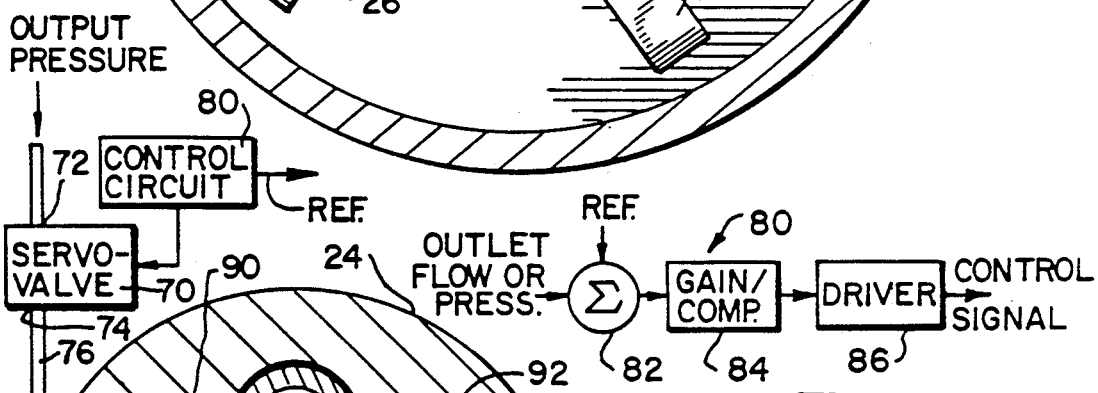
FIG. 5 comprises an electrical block diagram of the control circuit of FIG. 4.

FIG. 5 illustrates the control circuit 80 in greater detail. The circuit may be replaced by a different type of control circuit that implements a different control function, if desired The control circuit 80 includes a summer 82 that receives a signal representing outlet flow or pressure and the reference signal REF. The summer subtracts the signal REF from the signal representing outlet flow or pressure to develop an error signal that is processed by a gain and compensation circuit 84. The resulting signal is in turn applied to a driver 86 that in turn develops a control signal for the servovalve 70.

If desired, the pressures within the first and second recess portions 54, 55 may instead be controlled by different devices, such as hydromechanical controls which sense flow and/or pressure and which provide fluid under pressure to the portions 54, 55. Still further, the probe 16 can be moved by different apparatus, such as an actuator which rotates the probe 16 in response to sensed parameters, such as output flow or pressure and the like.

The foregoing embodiments are capable of delivering constant pressure regardless of variations in flow and/or prime mover speed and flow or constant flow regardless of variations in pressure and/or prime mover speed. The control is effected proportionally using an actuator that senses operating parameters In an alternative embodiment particularly useful for an aircraft fuel system having two operating points, stops 90 and 92 may be provided that correspond to the two desired operating points. The probe position is then not controlled proportionally but driven so that the vane 50 contacts one stop or the other depending upon which operating point is selected The vane 50 is driven to stop 90 by supplying outlet pressure to the recess portion 55 while venting the recess portion 54 to inlet pressure, and driven to stop 92 by reversing the pressure in recess portions 54 and 55.

In summary, the probe tip is positionable within a range of radial distances within the circular fluid flow so that the probe tip 44 is exposed to the varying static fluid head and dynamic fluid head that occur within this range of positions. Fluid outside the probe tip 44 continues to rotate essentially as a solid body so that pump loses are low. The probe 16 is designed so that flow disturbance is kept to a minimum. A pump operating parameter such as outlet pressure, outlet flow, power consumption or other parameter may be controlled by controlling the position of the probe tip 44. This movement can be effected by an actuator powered by an external source or by fluid taken from the pump inlet and/or outlet. Controllability is thereby enhanced and efficiency is greatly increased.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention The details of the structure may be varied substantially without departing from the spirit of the invention, and the exclusive use of all modifications which come within the scope of the appended claims is reserved.

I claim:

1. A pitot pump for pressurizing a fluid, comprising:

a rotatable housing having a housing inlet through which fluid may be passed and means for inducing a rotating flow of fluid in a volume of space within the housing;

a probe disposed in the housing and having a movable probe inlet disposed in the volume of space and a probe outlet at which an outlet fluid flow is established; and means coupled to the probe and responsive to a condition of the fluid for controlling a parameter of the outlet fluid flow by moving the probe inlet within a range of positions within the rotating flow of fluid.

2. The pitot pump of claim 1, wherein the rotating flow of fluid is induced in a circular direction about a flow axis of rotation and the probe is rotatable about a probe axis displaced from the flow axis.

3. The pitot pump of claim 2, wherein the probe includes a first portion transverse to the flow axis that carries the probe inlet and a second portion that carries the probe outlet.

4. A pitot pump for pressurizing a fluid, comprising:

a rotatable housing having a housing inlet through which fluid may be passed and means for inducing a rotating flow of fluid in a volume of space within the housing;

a probe disposed in the housing and having a movable probe inlet disposed in the volume of space and a probe outlet at which an outlet fluid flow is established; and means for moving the probe inlet within a range of positions within the rotating flow of fluid whereby a parameter of the outlet fluid flow can be controlled, wherein the moving means comprises a vane disposed on the probe and responsive to a pressure differential.

5. The pitot pump of claim 4, wherein the outlet fluid flow is developed at an outlet pressure and wherein the vane receives the outlet pressure on a first side thereof and a second pressure on a second side thereof opposite the first side.

6. The pitot pump of claim 5, wherein the second pressure is exerted by a spring.

7. The pitot pump of claim 5, wherein the fluid is delivered to the housing inlet at an inlet pressure and wherein the vane receives the inlet pressure and a pressure exerted by a spring on the second side thereof.

8. The pitot pump of claim 4, wherein the fluid is delivered to the housing inlet at an inlet pressure and wherein the vane receives the inlet pressure on a first side thereof and a second pressure on a second side thereof opposite the first side.

9. The pitot pump of claim 4, wherein the outlet fluid flow is developed at an outlet pressure and the second pressure is developed by a servovalve responsive to the outlet pressure.

10. The pitot pump of claim 9, wherein the servovalve includes an input that receives a flow of fluid at the output pressure and an output at which the second pressure is developed and wherein the servovalve is controlled by a control signal developed by a control circuit

11. The pitot pump of claim 10, wherein the control circuit is responsive to a feedback signal representing outlet fluid flow rate whereby such flow rate is maintained at substantially a constant value.

12. The pitot pump of claim 10, wherein the control circuit is responsive to a feedback signal representing outlet pressure whereby such pressure is maintained at substantially a constant value.

13. A pitot pump for pressurizing a fluid delivered to the pump, comprising:

a rotatable housing having a housing inlet through which fluid is passed and means for inducing a rotating flow of fluid about a flow axis in a volume of space within the housing;

a probe disposed in the housing and having a first portion substantially prependicular to the flow axis and carrying a probe inlet at an end thereof movable within the volume of space and a second portion coupled to the first portion and carrying a probe outlet at which an outlet fluid flow at an output pressure is established; and a vane coupled to the second portion of the probe and responsive to the output pressure for controlling the position of the probe inlet to thereby control a parameter of the outlet fluid flow.

14. The pitot pump of claim 13, wherein the vane is further responsive to pressure exerted by a spring.

15. The pitot pump of claim 13, wherein the fluid is delivered to the pump at an input pressure and wherein the vane is further responsive to the input pressure and a pressure exerted by a spring.

16. The pitot pump of claim 13, further including a servovalve having an inlet that receives the output pressure and an outlet in fluid communication with the vane wherein the servovalve is responsive to a control circuit.

17. The pitot pump of claim 16, wherein the outlet fluid flow is developed at an outlet flow rate and wherein the control circuit is responsive to a feedback signal representing outlet fluid flow rate whereby such flow rate is maintained at a substantially constant value.

18. The pitot pump of claim 16, wherein the control circuit is responsive to a feedback signal representing outlet pressure whereby such pressure is maintained at a substantially constant value.

* * * * *